US005120401A

United States Patent [19]

Kiviranta et al.

[11] Patent Number: 5,120,401

[45] Date of Patent: Jun. 9, 1992

[54] MIST REMOVAL DEVICE IN A PAPER MACHINE

[75] Inventors: Seppo Kiviranta, Jyväskylä ; Tuomo Kari, Palokka, both of Finland

[73] Assignee: Valmet Paper Machinery Inc., Finland

[21] Appl. No.: 686,025

[22] Filed: Apr. 16, 1991

[30] Foreign Application Priority Data

Apr. 19, 1990 [FI] Finland ..... 902000

[51] Int. Cl.[5] ..... D21F 1/32

[52] U.S. Cl. ..... 162/275; 162/279

[58] Field of Search ..... 162/272, 274, 275, 278, 162/279, 297, 308, 363, 364

[56] References Cited

U.S. PATENT DOCUMENTS 1,434,318 10/1922 Schwartz ..... 162/274
1,501,179 7/1924 Peacock et al. ..... 162/279

FOREIGN PATENT DOCUMENTS 0136000 4/1985 European Pat. Off. ..... 162/301
1079719 3/1984 U.S.S.R. ..... 162/274

*Primary Examiner*—Karen M. Hastings
*Attorney, Agent, or Firm*—Steinberg & Raskin

[57] ABSTRACT

The invention is related to a device in a paper machine for collecting the mist that is produced in the spraying of high-pressure water employed in the washing of a wire. The device includes an inlet duct extending across the wire width. The central axis of the device is at an oblique angle in relation to the direction of running of the wire. The device includes a jet guide in connection with an inlet opening of the inlet duct. The jet guide is connected to the frame by means of adjusting members and operates as an air closure and as a regulator of suction capacity. The position of the jet guide can be adjusted relative the surface plane of the wire by means of the adjusting member.

6 Claims, 4 Drawing Sheets

MIST REMOVAL DEVICE IN A PAPER MACHINE

FIELD OF THE INVENTION

The invention concerns a device in a paper machine for removal of mist produced during high-pressure washing.

BACKGROUND OF THE INVENTION

In the prior art, the use of negative pressure is known for removal of the mist produced in high-pressure washing of the wire. However, the prior art methods and equipment have not operated satisfactorily, and, therefore, gathering of dirt and impurities around the wire guide rolls and other auxiliary equipment has been a constant problem.

SUMMARY OF THE INVENTION

The present invention relates to a device that gathers mist, i.e. a mist trap, which is provided with an adjustable profile bar extending across the width of the wire, whereby, by regulating the position of the profile bar, the suction of the mist trap can be regulated. The present invention also relates to a device with a duct portion that is at an oblique angle relative to the direction of running of the wire. Thus, in the invention, it has been realized to take advantage of the impulse received by the mist from the wire and of the direction of the mist in the collecting of the mist into the device.

One aspect of the invention comprises an inlet duct extending across the wire width whose central axis is at an oblique angle in relation to the direction of running of the wire, and a jet guide in connection with the inlet opening of the inlet duct. The jet guide preferably comprises a plate-shaped part connected to the frame by means of adjusting members and operating as an air closure and as a regulator of suction capacity, the position of the jet guide being adjustable in relation to the surface plane of the wire, for example, by means of the adjusting members.

More particularly, the present invention relates to a wire running in a first direction and having a surface plane, a washing device fitted below the wire, the washing device spraying water under high pressure onto said wire, and a mist collection device arranged above the wire. The mist collection device comprises a frame having an interior and extending across a width of the wire. The mist collection device comprises a frame, an inlet duct, a jet guide, suction means, and collection means. The frame has an interior and extends across the width of the wire. The inlet duct has a central axis disposed at an oblique angle relative to the wire, and is provided with an opening for receiving mist produced in the spraying of said wire by the washing device. The jet guide is arranged in proximity to the inlet opening of the inlet duct, and is attached to the frame via adjustment means. The adjustment means allow the position of the jet guide to be adjusted in relation to the surface plane of the wire, and operates as an air closure and as a regulator of suction capacity. The suction means produces a negative pressure in an interior of the frame such that the mist is sucked through the inlet duct, and the collection means collects and removes the mist which is sucked through the inlet duct.

BRIEF DESCRIPTION OF THE DRAWINGS

In the following, the invention will be described with reference to some preferred embodiments of the invention illustrated in the Figures in the accompanying drawings, the invention however, not intended to be confined to said embodiments alone.

DETAILED DESCRIPTION

Figure 1:
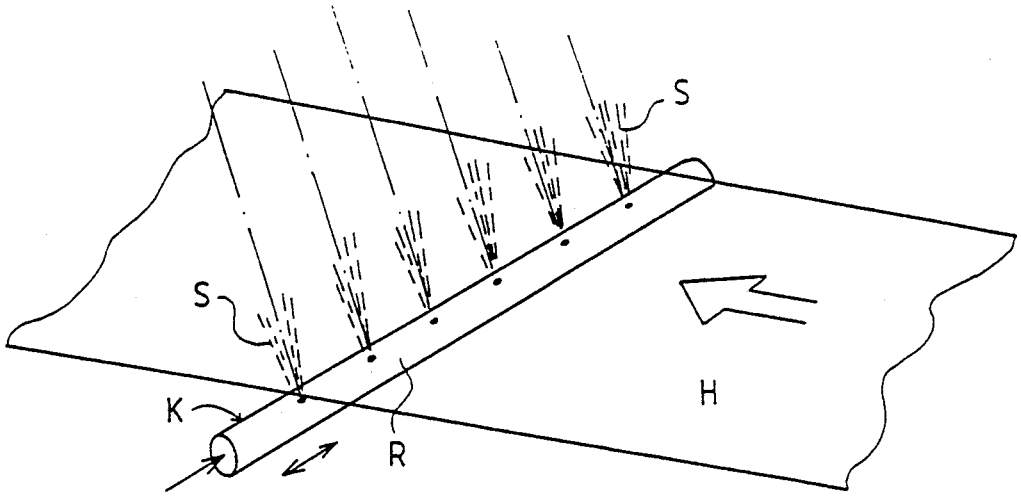
FIG. 1 is a plan view illustrating high-pressure washing in accordance with the prior art showing the direction of the mist jet.

In FIG. 1 the problem area of the paper machine is illustrated. A high-pressure washing device K is shown to be fitted in connection with the lower wire in a paper machine. A high-pressure washing jet passed through the jet pipe R is oscillated, whereby the washing jet can be efficiently directed out of the nozzle openings in the jet pipe R to different points on the wire.

As is shown in FIG. 1, the mist S is directed obliquely to the normal plane of the wire. Thus, the direction of the mist S is affected by the direction of running of the wire, by the wire speed, by the initial velocity produced for the jet, and by the initial direction of the mist.

Figure 2:
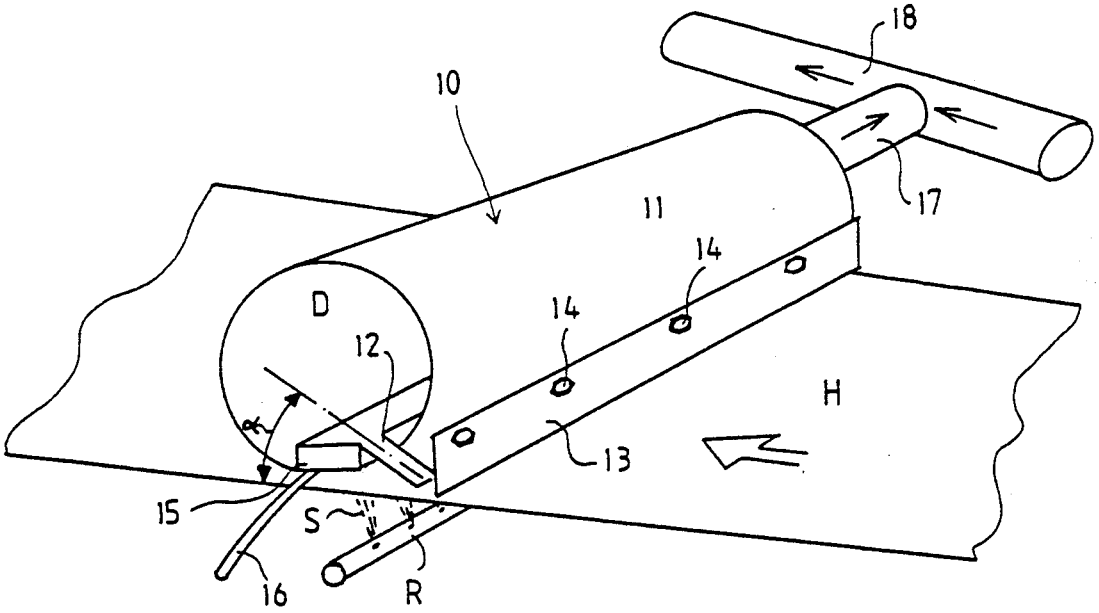
FIG. 2 is a schematic illustration of an embodiment of the invention used for removal of the mist produced in high-pressure washing of a lower wire.

As is shown in FIG. 2, in the collecting of the mist S, the mist S is collected in a space D in the interior of the frame 11 of the mist remover device 10 through an inlet duct 12 extending across the wire width. The central axis of the duct 12 is placed at an oblique angle a in relation to the direction of running of the wire H. The angle is preferably from about 30° to about 60°, and most preferably about 45°. Thus, the invention takes advantage of the direction of the mist in the collecting of the mist. During the passage of the mist through the wire H, the direction of the mist is changed, and the mist receives a transverse component for its direction from the wire H. On the other side of the wire, the mist jet is at a substantially oblique angle in relation to the direction of running of the wire, said angle being about 45° in relation to the direction of running of the wire H. The direction of the mist varies depending on the wire speed.

According to the invention, the device 10 comprises a jet guide 13 attached to the frame 11 and placed at the proximity of the inlet duct 12. The jet guide 13 is attached to the frame 11 of the device 10 by means of adjusting screws 14. The jet guide 13 is a plate-shaped component, whose function is to act as an air closure and as a regulator of the suction capacity. The jet guide 13 also acts as a means of protection, preventing any contact between the frame 11 and the wire H. When the adjusting screws 14 are loosened, it is possible to adjust the distance of the jet guide 13 from the wire H face accurately. The device further comprises a collector trough 15 for exhaust water, and a drain pipe 16 for same. Through the drain pipe 16, the exhaust water or equivalent condensed and gathered in the exhaust trough 15 is drained off. A suction duct 17 is opened in the space D in the interior of the frame 11 of the mist remover 10 which may communicate with the outlet duct 18 of the overall air-conditioning of the paper machine. The exhaust capacity of the device is from about 4 to about 6 $m^3$ per second.

Figure 3:
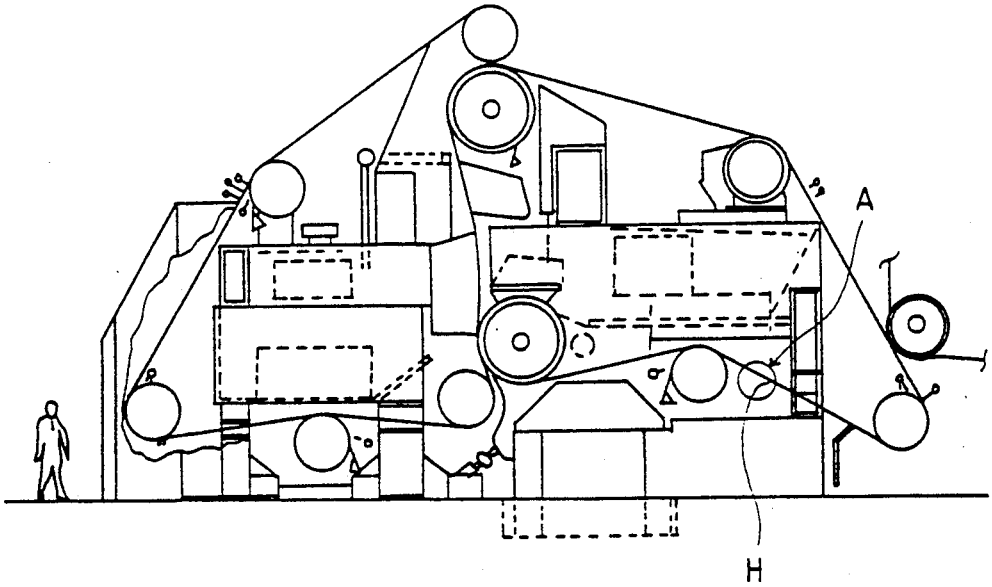
FIG. 3 is a side view showing the location of a mist remover in accordance with the invention in connection with a Speed-Former in a paper machine.

FIG. 3 shows a preferred location of a mist remover in accordance with the invention in connection with the inner wire of a Speed-Former in a paper machine. The equipment 10 is placed on the return run of the inner wire H at the point A, in the way shown in FIG. 3.

Figure 4:
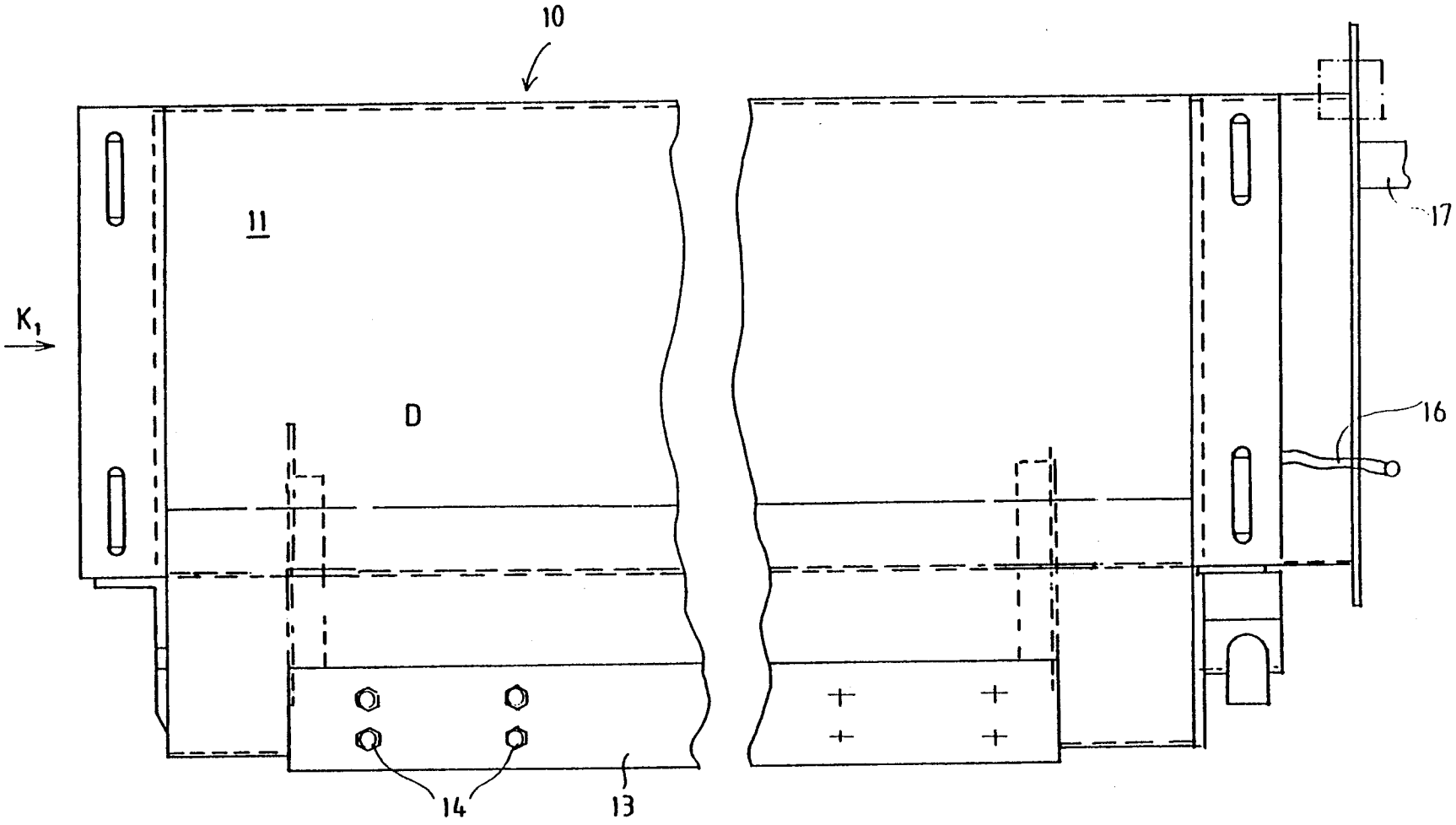
FIG. 4 is a more detailed illustration of an embodiment of the invention providing a longitudinal view of the equipment for removal of the mist produced in high-pressure washing, viewed in the machine direction.

FIG. 4 is a more detailed illustration of the device 10 in accordance with the invention for removal of the mist produced in high-pressure washing. In FIG. 4, the device 10 is shown as viewed in the machine direction of the paper machine. The jet guide 13, which extends across the wire width, is attached to the frame 11 by means of screws 14, the suction capacity being regulated by means of said jet guide 13, the jet guide 13 at the same time operating as an air closure, thereby permitting an efficient removal of mist. In the interior of the frame 11, there is a collecting space D, into which a suction duct 17 is opened. In the space inside the frame 11, a collector trough 15 is provided for the exhaust water, an exhaust pipe 16 being opened into said trough 15, through which pipe 16 the water gathered in the collector trough 15 can be drained.

Figure 5:
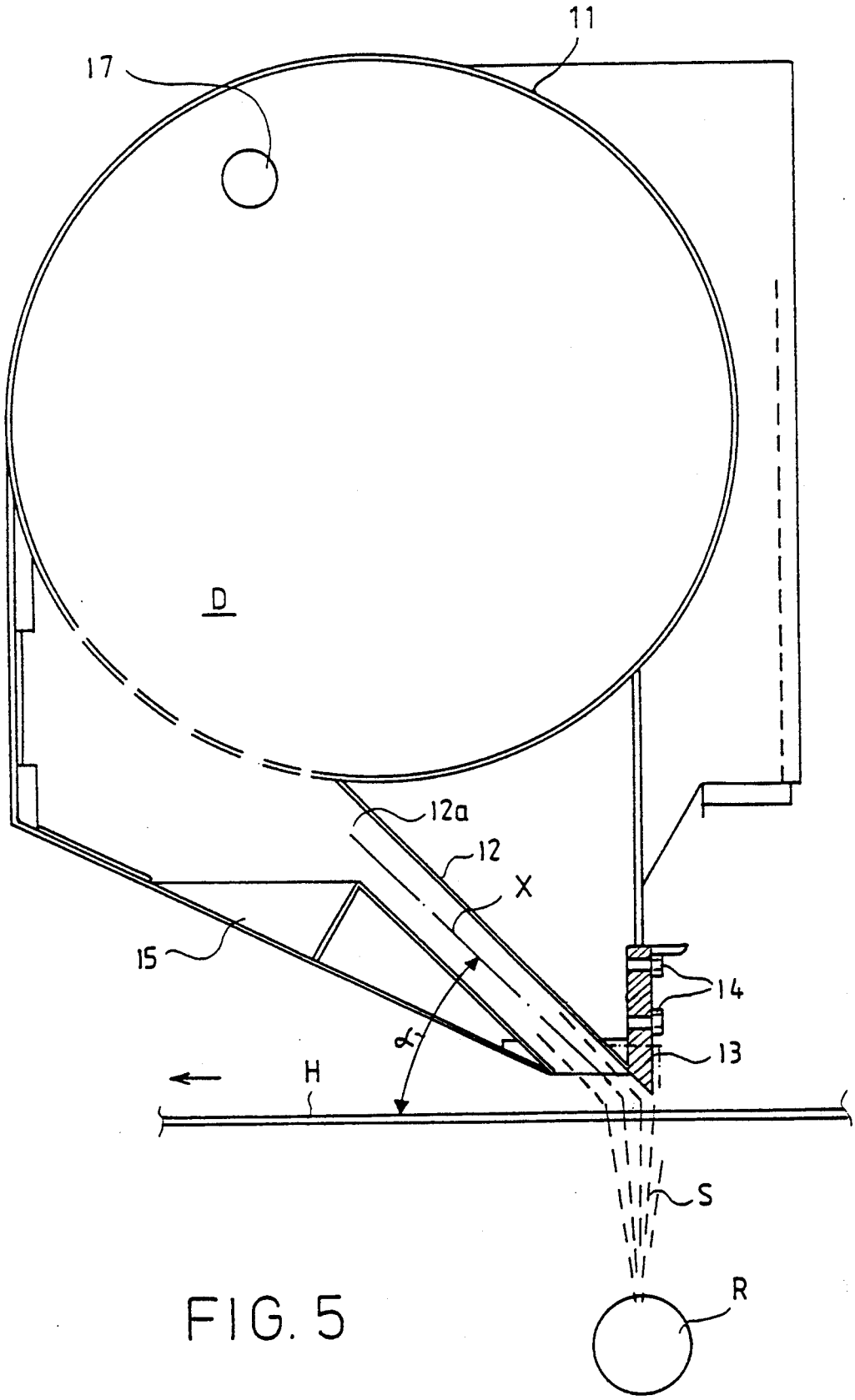
FIG. 5 shows the mist-removing equipment as viewed in the direction K indicated in FIG. 4

In FIG. 5, the equipment is shown as viewed in the direction of the arrow $K_1$ shown in FIG. 4. As is shown, the frame includes an inner space D, and in the space D a collector trough 15, into which the end 12*a* of the inlet duct 12 is opened. The central axis X of the inlet duct 12 is placed at an oblique angle in relation to the direction of running $L_1$, of the wire H. Thus, efficient use is made of the mist-directing effect of the wire. The mist is directed straight into the inlet duct 12 without a necessity to produce additional changes in the direction of the mist inside, or at the proximity of, the device. By means of the adjusting screws 14, the position of the jet guide 13, preferably of a plastic rib at the inlet edge, in relation to the wire H face is adjusted. In the figure, a screw 14 is shown, by means of whose loosening it is possible to adjust the jet guide 13, preferably a plastic rib, to the desired height position in relation to the surface plane of the wire. The frame 11 is connected with a screw device, by whose means the position of the whole device 10 in relation to the wire H draw can be adjusted.

The examples provided are not meant to be exclusive. Many variations of the present invention would be obvious to those skilled in the art, and are contemplated to be within the scope of the appended claims.

What is claimed is:

1. A paper machine, comprising a wire having a mist-directing effect running in a first direction and defining a surface plane, a washing device fitted below said wire, said washing device spraying water under high pressure onto said wire, such that water mist is produced above the wire.

a mist collection device arranged above said wire, said mist collection device comprising a frame extending across a width of said wire, said frame having an interior, an inlet duct extending across the width of the wire, the inlet duct having a central axis disposed at an oblique angle from about 30° to about 60° relative to said surface plane of said wire, said inlet duct having an opening for receiving mist produced in the spraying of said wire by said washing device, a jet guide arranged in proximity to said inlet opening of said inlet duct, said jet guide attached to said frame via adjustment means, said adjustment means allowing the position of said jet guide to be adjusted in relation to said surface plane of said wire, and in response to the mist-directing effect of the wire in order to maximize collection of mist by said mist collection device, said jet guide structured and arranged to act as an air closure and as a regulator of suction capacity, suction means for producing a negative pressure in an interior of said frame such that the mist is sucked through said inlet duct, and collection means for collecting and removing the mist which is sucked through said inlet duct.

2. The device of claim 1, wherein said collection means comprises a collector trough in said interior of said frame and a drain pipe.

3. The device of claim 1, wherein said suction means comprises a suction duct in said interior of said frame.

4. The device of claim 1, wherein said jet guide is plate-shaped.

5. In a mist collection device in combination with a paper machine equipped with a washing device spraying high pressure water onto a wire having a mist-directing effect, the improvement comprising said washing device being arranged below the wire and the mist collection device being arranged above the wire, said mist collection device having an inlet duct arranged at an oblique angle from about 30° to about 60° relative to the surface plane of the running of the wire, said mist collection device being further provided with adjustment means structured and arranged to maximize the collection of water mist into said inlet duct in accordance with the mist-directing effect of the wire.

6. The mist collection device of claim 5, further comprising a jet guide structured and arranged to act as air closure and as a regulated of an suction capacity of said mist collection device, and said adjustment means comprises means for adjusting said jet guide in relation to the surface plane of the wire.

* * * * *